United States Patent [19]

van Zee et al.

[11] Patent Number: 4,789,203

[45] Date of Patent: Dec. 6, 1988

[54] CHAIR WITH MOVABLE SEAT AND BACKREST

[75] Inventors: Eric van Zee, Delft; Harm Boomsma, Hendrik Ido Ambacht; Ronald Lewerissa; Jeroen Verbrugge, both of Delft, all of Netherlands

[73] Assignee: Ahrend Groep N.V., Amsterdam, Netherlands

[21] Appl. No.: 15,189

[22] Filed: Feb. 13, 1987

[30] Foreign Application Priority Data

Oct. 6, 1986 [NL] Netherlands ..... 8602506

[51] Int. Cl.[4] ..... A47C 1/02

[52] U.S. Cl. ..... 297/316; 297/300

[58] Field of Search ..... 297/300, 301, 316

[56] References Cited

U.S. PATENT DOCUMENTS

| | | | |
|---|---|---|---|
| 2,083,838 | 6/1937 | Goenen | 297/316 X |
| 2,855,026 | 10/1958 | Simons et al. | 297/300 |
| 3,711,149 | 1/1973 | Carter | 297/316 X |
| 4,027,843 | 6/1977 | Thompson | 297/300 X |
| 4,057,214 | 11/1977 | Harder, Jr. | 297/300 X |
| 4,502,729 | 3/1985 | Locher | 297/300 X |
| 4,533,177 | 8/1985 | Latone | 297/301 |
| 4,682,814 | 7/1987 | Hansen | 297/300 |

FOREIGN PATENT DOCUMENTS

| | | | |
|---|---|---|---|
| 0105955 | 4/1984 | European Pat. Off. . | |
| 2855915 | 6/1980 | Fed. Rep. of Germany | 297/300 |
| 3139448 | 4/1983 | Fed. Rep. of Germany . | |
| 3203401 | 8/1983 | Fed. Rep. of Germany | 297/316 |
| 3322450 | 1/1985 | Fed. Rep. of Germany | 297/300 |
| 1128948 | 12/1984 | U.S.S.R. | 297/316 |
| 1078215 | 8/1967 | United Kingdom . | |
| 2092438 | 8/1982 | United Kingdom . | |

*Primary Examiner*—Kenneth J. Dorner
*Assistant Examiner*—Laurie K. Cranmer
*Attorney, Agent, or Firm*—Foley & Lardner, Schwartz, Jeffery, Schwaab, Mack, Blumenthal & Evans

[57] ABSTRACT

Chair comprising a support element, a seat and a backrest, the seat consisting of a foremost portion being rigidly connected to the support element and of a rear portion being pivotally connected to the support element and being supported by an arm at some distance from its pivot, said arm being positioned beneath the seat and carrying the backrest. Said arm being pivotally connected to the support element and being biased by a progressively acting spring member towards the position which the rear seat portion and the backrest are occupying in the unloaded state.

5 Claims, 1 Drawing Sheet

CHAIR WITH MOVABLE SEAT AND BACKREST

Figure 1:
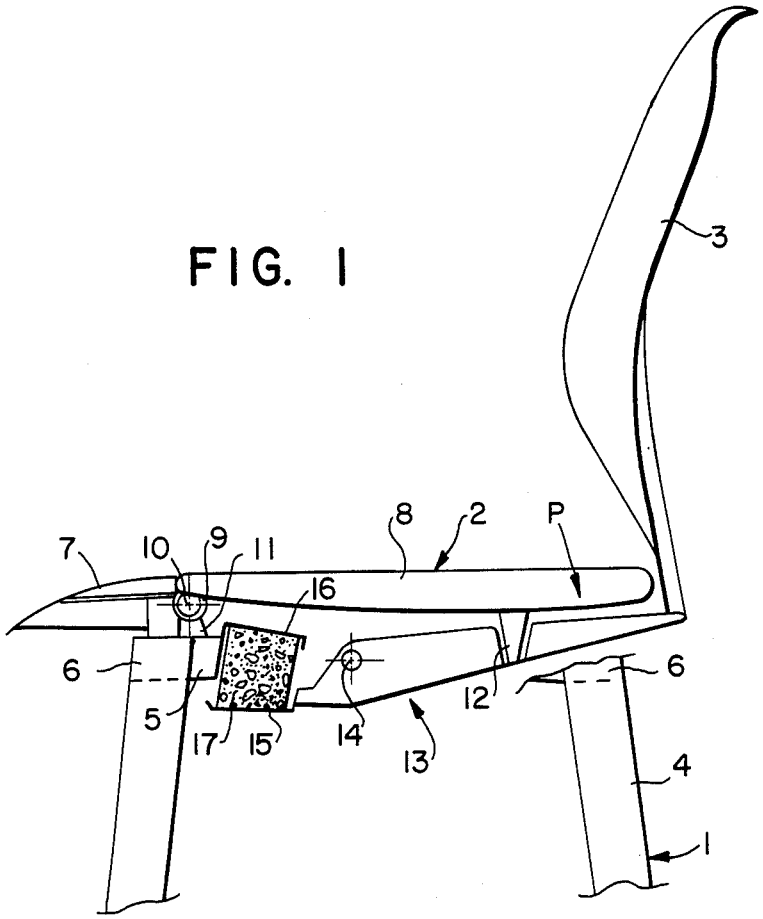

The invention relates to a chair comprising a support element, a seat and a backrest, the seat consisting of a foremost portion being rigidly connected to the support element and of a rear portion being pivotally connected to the support element adjacent its forward edge which is engaging the foremost portion, said rear portion and said backrest being biased by at least one spring member towards that position which these parts are occupying in the unloaded state.

Such a chair is known from U.S. patent specification No. 4,533,177. I this known chair the rear seat portion and the back rest are forming an integral unit so that pivoting of one part in respect of the other, if any, only can take place by elastic deformation of said unit.

Additionally the spring member of this known chair is made in the shape of two telescopically movable parts which are biased outwardly by a helical spring. If such a spring member is loaded the force exerted by it will increase substantially linearly. To make such a chair suitable for persons with different weights and shapes the spring member is executed such that the effective length of the helical sprig is adjustable. After adjustment of the spring member this known chair may offer a reasonable sitting comfort to a specific person so that such a chair can be used as office chair. So it is indicated in said patent specification that, generally speaking, the support element will be executed such that the seat and back rest can swivel about a vertical axis and are adjustable in height.

The invention has as an object to provide a chair with such a sitting comfort that such a chair can be used in public areas, canteens, district centers, etc., in which the chair is used under various conditions and by persons with very different weights and shapes. In that case the chair has to offer an optimal sitting comfort to the one sitting thereon during various conditions of use, so sitting positions.

According to the invention this is achieved in that the rear seat portion is supported by an arm at some distance from its pivot, said arm being positioned beneath the seat and extending substantially parallel thereto, said arm carrying the backrest and being pivotally connected to the support element at a point located beneath the seat and, as seen in plan view, being located between the pivot of the rearward seat portion and that point where this seat portion is supported by said arm, said spring member being formed by a progressively acting spring member affecting said arm.

When applying the above described features it can be achieved that the chair is offering the desired sitting comfort for persons both light and heavy in weight. Via the rear seat portion in both cases a force will be exerted on said arm carrying the backrest, by the weight of the person, whereby the arm will have the tendency to pivot over a specific angle, said pivoting being opposed by said progressively acting spring member. The progressive action of the spring member is of particular importance because a spring member with a linear spring characteristic would not be abe to provide the desired effect.

In particular the progressively acting spring member will be in the shape of at least one block microcellular polyurethane, being located between said arm and a member which is fixedly connected to said support element.

Because the pivot of said arm carrying the back rest is located between the pivot of the rear seat portion and the point where this seat portion is resting on said arm, the backrest will always carry out a larger angular rotation than the seat portion. This means that when leaning backward the backrest will be rotated more than the seat portion. This is of much importance as from an ergonomic point of view a specific angle between seat and backrest is desirable for various sitting positions.

It has appeared that for obtaining an optimal sitting comfort the ratio between the angular rotations of the rear seat portion and of the backrest should be within the range of 1:1.8 and 1:2.2. In the preferred embodiment of a chair according to the present invention the width of the foremost fixed seat portion, as seen in horizontal direction from the forward edge up to the pivot of the second seat portion is within the range of 130 to 200 mm, whereas the distance between said pivot and the point where the arm carrying the backrest is pivotally connected to the support element will be substantially equal to the distance between the pivot of said arm and the point where the rear seat portion is supported by said arm, said distances being in the range of 100 to 120 mm.

In this preferably the progressively acting spring member will be positioned between the pivots of said seat portion and said arm.

Figure 2:
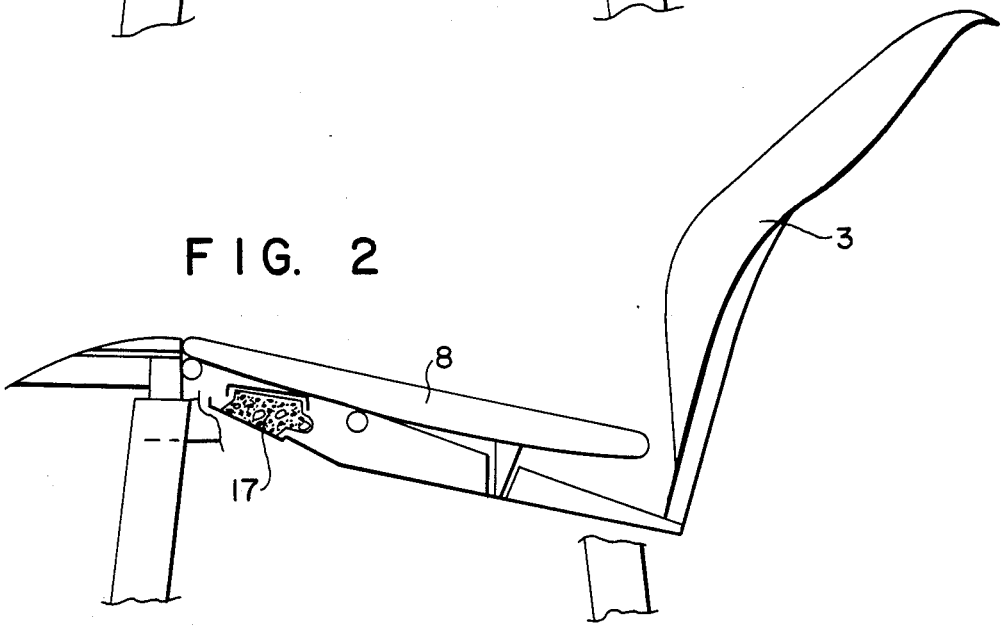

Now the invention will be further elucidated with reference to an embodiment, shown in the drawing, in which:

FIG. 1 schematically shows a side view of a chair according to the invention, in which for the sake of clearness specific parts have been deleted; and FIG. 2 shows a view according to FIG. 1, but with the rear seat portion and the backrest in a pivoted position.

The shown chair comprises a support element 1, a seat 2 and a backrest 3. The support element 1 comprises four legs 4, which are interconnected by the beams 5 and 6.

The seat 2 consists of the foremost portion 7 which is fixedly connected to the support element 1, and of the rear portion 8. The seat portion 8 is provided with lugs 9 near the foremost edge engaging the seat portion 7, through which lugs the shaft 10 extends, which on the other hand is running through lugs 11 connected to the support element 1.

Further the seat portion 8 is provided with a projection 12 which rests on an arm 13 being fixedly connected to the back rest 3. The arm 13 is pivotally supported by the shaft 14, which in a manner not shown, is connected to the support element 1.

Between the foremost portion 15 of the arm 13 and an element 16 fixedly connected to the support element 1 the spring member 17 is mounted. This member consists of one or more blocks of microcellular polyurethane providing a progressive spring characteristic.

As already said above the width a of the fixed foremost seat portion 7 in particular will be within the range of 130 to 200 mm. The distance b between the pivots 10 and 14 preferably will be substantially equal to the distance c between the pivot 14 and the projection 12. In this the distances b and c will be within the range of 100 to 120 mm and preferably will be 110 mm. In this the distance c is measured in the unloaded state of the seat portion 8 and will become slightly smaller when the seat portion 8 is pivoting in the direction of the arrow P when a person is sitting down of the seat portion 8.

Depending on the position the relating person will assume, the seat portion 8 will pivot more or less for example to the position shown in FIG. 2, during which the backrest 3 will rotate over a larger angle, to wit over an angle which is about twice as large as the angle over which the seat portion 8 is rotated. The rotation of the seat portion 8 and of the backrest 3 will be limited by the progressively acting spring member 17.

It will be obvious that only a possible embodiment of a chair according to the invention is shown in the drawing and has been discussed above and that many modifications may be applied without departing from the inventive concept. So for example it is possible to construct the support element in a completely different way so as in the shape of a column with at its lower end laterally extending legs. Al these possibilities, however, will be obvious for an expert and do not need further elucidation.

We claim:

1. A chair comprising a rigid support element, a seat and a backrest, the seat comprising a foremost portion being rigidly connected to the rigid support element thereby forming a rigid portion and a rear portion being pivotally connected to the support element adjacent its forward edge, the rear seat portion extending a longer distance between the pivotal connection and the backrest than a distance between the pivotal connection and a forward end of the foremost portion, and the rear seat portion being supported by an arm at a distance from its pivot, the arm being positioned beneath the seat and extending substantially parallel thereto, the arm carrying the backrest and being pivotally connected to the support element at a point located beneath the seat between the pivot of the rear seat portion and a point where the rear seat portion is supported by the arm, a spring member being formed by a spring element having a progressive non-linear spring characteristic disposed between the arm and the support element to bias the arm together with rear seat portion and the backrest to a position in an unloaded state.

2. Chair according to claim 1, characterized in that the progressively acting spring member is in the shape of at least one block microcellular polyurethane, being located between said arm and a member which is fixedly connected to said support element.

3. Chair according to claim 1 characterized in that the ratio between the angular rotations of the rear seat portion and of the backrest is lying within the range of 1:1.8 and 1:2.2.

4. Chair according to claim 1 characterized in that the width of the foremost fixed seat portion, as seen in horizontal direction from the forward edge up to the pivot of the second seat portion is within the range of 130 to 200 mm, whereas the distance between said pivot and the point where the arm carrying the backrest is pivotally connected to the support element will be substantially equal to the distance between the pivot of said arm and the point where the rear seat portion is supported by said arm, said distances being in the range of 100 to 120 mm.

5. Chair according to claim 1 characterized in that the progressively acting spring member is positioned between the pivots of said rear seat portion and said arm.

* * * * *